US008049060B2

(12) United States Patent
Vinson et al.

(10) Patent No.: US 8,049,060 B2
(45) Date of Patent: Nov. 1, 2011

(54) BULK SOFTENED FIBROUS STRUCTURES

(75) Inventors: Kenneth Douglas Vinson, Cincinnati, OH (US); Michael Scott Prodoehl, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 809 days.

(21) Appl. No.: 11/478,051

(22) Filed: Jun. 29, 2006

(65) Prior Publication Data

US 2007/0044930 A1 Mar. 1, 2007

Related U.S. Application Data

(60) Provisional application No. 60/772,107, filed on Feb. 10, 2006, provisional application No. 60/711,736, filed on Aug. 26, 2005.

(51) Int. Cl.
*A61F 13/15* (2006.01)

(52) U.S. Cl. ..... 604/360; 604/359; 604/366

(58) Field of Classification Search ..... 604/360, 604/359, 366; 162/158; 424/401
See application file for complete search history.

(56) References Cited

U.S. PATENT DOCUMENTS

| | | | | |
|---|---|---|---|---|
| 2,826,551 | A | 3/1958 | Green | |
| 3,301,746 | A | 1/1967 | Sanford et al. | |
| 3,473,576 | A | 10/1969 | Amneus | |
| 3,573,164 | A | 3/1971 | Friedberg et al. | |
| 3,821,068 | A | 6/1974 | Shaw | |
| 3,825,381 | A | 7/1974 | Dunning et al. | |
| 3,949,035 | A | 4/1976 | Dunning et al. | |
| 3,964,500 | A | 6/1976 | Drakoff | |
| 3,974,025 | A | 8/1976 | Ayers | |
| 3,994,771 | A | 11/1976 | Morgan, Jr. et al. | |
| 4,100,324 | A | 7/1978 | Anderson et al. | |
| 4,166,011 | A | 8/1979 | Lugstenmann et al. | |
| 4,191,609 | A | 3/1980 | Trokhan | |
| 4,239,065 | A | 12/1980 | Trokhan | |
| 4,300,981 | A | 11/1981 | Carstens | |
| 4,364,837 | A | 12/1982 | Pader | |
| 4,528,239 | A | 7/1985 | Trokhan | |
| 4,613,447 | A * | 9/1986 | Hara et al. | 15/104.93 |
| 4,637,859 | A | 1/1987 | Trokhan | |
| 5,059,282 | A | 10/1991 | Ampulski et al. | |
| 5,215,626 | A | 6/1993 | Ampulski et al. | |
| 5,246,545 | A | 9/1993 | Ampulski et al. | |
| 5,449,551 | A | 9/1995 | Tamiguchi | |
| 5,525,345 | A | 6/1996 | Warner et al. | |
| 5,529,665 | A | 6/1996 | Kaun | |
| 5,552,020 | A | 9/1996 | Smith et al. | |
| 6,241,850 | B1 | 6/2001 | Kelly | |
| 6,547,928 | B2 | 4/2003 | Barnholtz et al. | |
| 6,607,637 | B1 | 8/2003 | Vinson et al. | |
| 6,755,939 | B2 | 6/2004 | Vinson et al. | |
| 6,797,117 | B1 | 9/2004 | McKay et al. | |
| 6,855,229 | B2 * | 2/2005 | McKay et al. | 162/179 |
| 7,582,577 | B2 | 9/2009 | Vinson | |
| 2003/0013627 | A1 | 1/2003 | Bermejo et al. | |
| 2004/0163782 | A1 * | 8/2004 | Hernandez-Munoa et al. | 162/91 |
| 2004/0188047 | A1 | 9/2004 | Nakamura et al. | |
| 2004/0234561 | A1 * | 11/2004 | Ansmann et al. | 424/401 |
| 2004/0255396 | A1 | 12/2004 | Vinson et al. | |
| 2005/0136097 | A1 | 6/2005 | Hsu | |
| 2007/0044930 | A1 | 3/2007 | Vinson et al. | |

FOREIGN PATENT DOCUMENTS

| | | |
|---|---|---|
| EP | 0613979 A1 | 9/1994 |
| GB | 849433 | 9/1960 |
| WO | WO 97/30217 | 8/1997 |
| WO | WO 00/04230 | 1/2000 |
| WO | WO 03/005981 | 1/2003 |

OTHER PUBLICATIONS

U.S. Appl. No. 11/387,301, filed Mar. 23, 2006, Kenneth Douglas Vinson.

Geffroy, et al., "Molar Mass Selectivity in the Adsorption of Polyacrylates on Calcite", *Colloids and Surfaces, A: Physicochemical and Engineering Aspects*, vol. 162, pp. 107-121 (2000).

* cited by examiner

*Primary Examiner* — Jacqueline F. Stephens
(74) *Attorney, Agent, or Firm* — C. Brank Cook

(57) ABSTRACT

Bulk softened fibrous structures, especially bulk softened, polar agent-free fibrous structures, and methods for making such fibrous structures are provided.

17 Claims, No Drawings

BULK SOFTENED FIBROUS STRUCTURES

CROSS REFERENCE TO RELATED APPLICATION

This application claims the benefit of U.S. Provisional Application No. 60/772,107, filed Feb. 10, 2006; and U.S. Provisional Application No. 60/711,736, filed Aug. 26, 2005.

FIELD OF THE INVENTION

This invention relates to fibrous structures, especially fibrous structures that are incorporated into sanitary tissue products. More particularly, the present invention relates to fibrous structures comprising a bulk softening agent and methods for making such fibrous structures.

BACKGROUND OF THE INVENTION

Sanitary tissue products often utilize fibrous structures that contain lotion and/or softening agents. Typically, such agents are designed to isolate to the surface of the sanitary tissue paper. In the case of a lotioned sanitary tissue product, surface isolation promotes the lotion transferring to the user's skin while in the case of a softened sanitary tissue product, surface isolation makes effective use of the softening agent by limiting it to a zone or zones of a the surface that are important for the perception of softness by a user.

Surface isolation is achieved by using lotions and/or softeners that have a relatively high melting point and/or contain bonding moieties which are capable of forming bonds with the fibers comprising the fibrous structure.

Formulators have found known surface isolation treatments to be lacking in providing bulk softness since they do not effectively migrate within and among fibers in order to maximally plasticize such fibers.

Accordingly, there is a need for fibrous structures that contain a bulk softening agent, sanitary tissue products comprising such fibrous structures and methods for making such fibrous structures.

SUMMARY OF THE INVENTION

The present invention fulfills the need described above by providing a fibrous structure, especially a polar agent-free fibrous structure, that comprises a bulk softening agent.

In one example of the present invention, a fibrous structure, especially a polar agent-free fibrous structure, comprising one or more fibers and a non-silicone oil system, is provided.

In another example, a fibrous structure, especially a polar agent-free fibrous structure comprising one or more fibers and a non-silicone oil system comprising a bulk softening agent wherein the bulk softening agent is only bonded to the fibers via van der waals forces, is provided.

In another example of the present invention, a fibrous structure, especially a polar agent-free fibrous structure, comprising a fiber having one or more moieties capable of forming a bond selected from the group consisting of: hydrogen bonds, ionic bonds, covalent bonds and mixtures thereof, and a bulk softening agent that is free of moieties that are capable of bonding with the moieties of the fiber is provided.

In another example of the present invention, a single- or multi-ply sanitary tissue product comprising a fibrous structure according to the present invention is provided.

In still another example of the present invention, a fibrous structure, especially a polar agent-free fibrous structure, comprising one or more fibers and a bulk softening agent, wherein the bulk softening agent is only bonded to the fibers via van der waals forces is provided. For example, the bulk softening agent is not bonded to a fiber via a hydrogen bond, an ionic bond or a covalent bond.

In even another example of the present invention, a fibrous structure, especially a polar agent-free fibrous structure, comprising a one or more fibers and a bulk softening agent wherein the bulk softening agent is present throughout the fibrous structure, wherein the bulk softening agent is only bonded to the fibers via van der waals forces is provided.

In still another example of the present invention, a method for treating a fibrous structure, the method comprising the step of applying a polar agent-free non-silicone oil system comprising a bulk softening agent to a surface of a fibrous structure such that the bulk softening agent becomes uniformly distributed throughout the fibrous structure, is provided.

In yet another example of the present invention, a method of treating a fibrous structure, the method comprising the step of applying a polar agent-free non-silicone oil system comprising a bulk softening agent to a surface of a fibrous structure, wherein at least 10% by weight of the bulk softening agent exhibits a particle size of greater than 500 μm such that the bulk softening agent becomes uniformly distributed throughout the fibrous structure.

In still yet another example of the present invention, a fibrous structure, especially a polar agent-free fibrous structure, comprising a bulk softening agent, wherein the bulk softening agent is present at a greater weight percent within the fibrous structure than on a surface of the fibrous structure, is provided.

In even yet another example of the present invention, a fibrous structure, especially a polar agent-free fibrous structure, comprising a bulk softening agent and a surface softening agent, wherein the surface softening agent is present on a surface of the fibrous structure such that the surface softening agent is capable of being contacted by a user's skin during use, is provided.

Accordingly, the present invention provides fibrous structures comprising a non-silicone oil system, fibrous structures comprising a bulk softening agent, sanitary tissue products comprising such fibrous structures and methods for treating fibrous structures with a bulk softening agent.

DETAILED DESCRIPTION OF THE INVENTION

Definitions

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers or synthetic fibers, or any other suitable fibers, and any combination thereof.

Natural fibrous structure-making fibers useful in the present invention include animal fibers, mineral fibers, and plant fibers. Animal fibers may, for example, be selected from the group consisting of: wool, silk and mixtures thereof. Plant fibers may, for example, be cellulosic fibers derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Cellulose fibers are most particularly preferred fiber used in the present invention since they may form hydrogen bonds owing to their alcohol functional groups. Further, they may form ionic bonds through carboxylic acid functionalities. Covalent bonds may be formed by taking advantage of the reactivity of either the alcohol or acid moieties.

Of the cellulose fibers, wood fibers, often referred to as wood pulps, are preferred. These include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. Nos. 4,300,981, 3,994,771 disclose layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers are also suitable and may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, starch derivatives, chitin and chitin derivatives such as chitosan); and mixtures thereof.

The web (fibrous structure) of the present invention may comprise fibers, films and/or foams that comprises a hydroxyl polymer and optionally a crosslinking system. Nonlimiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose derivatives such as cellulose ether and ester derivatives, gums, arabinans, galactans, proteins and various other polysaccharides and mixtures thereof. For example, a web of the present invention may comprise a continuous or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer.

"Fiber Length", "Average Fiber Length" and "Weighted Average Fiber Length", are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wis.

Fibrous structures may be comprised of a combination of long fibers and short fibers.

Nonlimiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Nonlimiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

"Fibrous structure" as used herein means a structure that comprises one or more fibers. Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

"Sanitary tissue product" comprises one or more finished fibrous structures, converted or not, that is useful as a wiping implement for post-urinary and post-bowel movement cleaning (toilet tissue), for otorhinolaryngological discharges (facial tissue), and multi-functional absorbent and cleaning uses (absorbent towels).

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Dry Tensile Strength" (or simply "Tensile Strength" as used herein) of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The cross-head speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

"Wet Tensile Strength" as defined herein is determined by the method described in ASTM D829-97 for Wet Tensile Breaking Strength of Paper and Paper Products, specifically by method 11.2 "Test Method B—Finch Procedure". The "Wet Tensile/Dry Tensile Ratio" as defined herein is the ratio of Wet Tensile to Dry Tensile as determined by the before mentioned methods. The "Wet Decay" is defined as the loss of wet tensile strength as measured after standing for 30 minutes in the soaked condition in the Finch Cup prior to recording the tensile measurement compared to the value recorded immediately after saturation according to the before mentioned method. More particularly, Wet Tensile Decay is defined as this loss as a percentage of the Wet Tensile as made immediately after saturating.

"Absorbent" and "absorbency" as used herein means the characteristic of the fibrous structure which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also. Absorbency is measured here in by the Horizontal Full Sheet (HFS) Absorbency Test Method described herein. In one example, the fibrous structures and/or sanitary tissue products according to the present invention exhibit an HFS absorbency of greater than about 5 g/g and/or greater than about 8 g/g and/or greater than about 10 g/g up to about 100 g/g. In another nonlimiting example, the fibrous structures and/or sanitary tissue products according to the present invention exhibit an HFS absorbency of from about 15 g/g to about 30 g/g.

"Sink Time" as used herein quantifies the hydrophilicity of fibrous structures by determining the period of time required for dry fibrous structure to become completely wetted with water. The method is contained in the Test Methods section herein.

"Vertical Full Sheet Absorbency" or "VFS" as used herein refers to the amount of distilled water absorbed and retained by the fibrous structure of the present invention when positioned vertically. VFS is measured as described in the Vertical Full Sheet (VFS) Absorbency Test Method described herein.

"Lint" as used herein means unbound and/or loosely bound fibers and/or particles that become disassociated from a fibrous structure and/or sanitary tissue product. A lint score, which is the quantification of the amount of fibers and/or particles that become disassociated from a fibrous structure during a lint test, is measured according to a standard lint test described in U.S. Pat. No. 6,241,850. In one example, the fibrous structures and/or sanitary tissue products of the present invention exhibit a lint score of less than about 6 and/or less than about 5 and/or less than about 4 and/or less than about 3.

"Polar agent-free" as used herein means that a material and/or fibrous structure does not contain more than 5% and/or 3% and/or 1% and/or 0.5% and/or 0.1% and/or 0% of a low volatility, polar agent. A polar agent, for purposes of the present invention, is mobile which means that it either is liquid or at least liquefiable below about 100° C. and exhibits low volatility if it has less than 10 mmHg vapor pressure at 25° C.

Nonlimiting examples of polar agents, especially low volatility polar agents, include hydroxyl bearing compounds such as low volatility alcohols such as fatty alcohols, low volatility glycols such as hexylene glycol, hydroxy acids such as glycolic acid, citric acid, glycerol, pentaerythritol, sugars (monosaccaharides, disaccaharides and higher oligimers such as present in starch hydrosolates such as high fructose corn syrup), sugar alcohols such as sorbitol and mannitol. Further nonlimiting examples of polar agents include_urea, alkoxylated compounds such as polyethylene glycol, polypropylene glycol and polyoxyethylene/polyoxypropylene copolymers. Further nonlimiting examples of polar agents include low volatility organic acids_such as fatty acids. Further nonlimiting examples of polar agents include anhydrides of sugar alcohols such as sorbitan, animal proteins such as gelatin, vegetable protein such as soybean, cottonseed and sunflower protein, Further nonlimiting examples of polar agents include all surfactants which by definition contain both a polar element and a non-polar element; thus these encompass all non-ionic, cationic, anionic, and zwitteronic surfactants. A nonlimiting list of surfactants may be found by referring to McCutcheon's Volume 1: Emulsifiers and Detergents 2002, North American Edition published by MC Publishing Company, Glen Rock, N.J. Nonlimiting examples of non-ionic surfactants include alcohol ethoxylates, alkyl phenol ethyoxylates, ethyloxated fatty esters and oils. Nonlmiting examples of cationic surfactants include imidazoline quaternary ammonium compounds and alkyl quaternary ammonium compounds especially those with one, two, or three fatty alkyl chains. Nonlimiting examples of anionic surfactants include sulfonates such as linear alkyl sulfonate. Nonlimiting examples of zwitterionic surfactants include ammonium carboxylate, ammonium sulfates, and amine oxides, in each case the molecule also containing a hydrophobic portion such as long alkyl chain.

Nonlimiting examples of non-polar agents include oils. "Oil" as used herein means natural animal, vegetable, mineral, silicone oils and other substances, especially liquids, that exhibit similar characteristics as one or more of such oils (i.e., liquid under use conditions (for example, in one case, temperatures from about 23 to 40° C.) and possessing a lubricating property). Aqueous-based materials, especially those materials that comprise a continuous phase comprising water or some other polar solvent, which have oil-like characteristics for the purposes of this invention are excluded from the definition of "oil" herein.

"Oil system" as used herein means a composition comprising one or more oils. In one example, an oil system of the present invention comprises at least about 80% and/or at least about 85% and/or at least about 90% and/or at least about 95% of an oil. "Non-silicone oil" as used herein means an oil that lacks a silicon moiety.

"Silicone oil" as used herein means an oil that comprises one or more silicon moieties.

"Non-silicone oil system" as used herein means that the oil system comprises less than 10% and/or less than 7% and/or less than 5% and/or less than 3% and/or less than 1% and/or 0% by volume of a silicone oil.

"Bulk Softening Agent" as used herein means an agent having molecular size and viscosity and surface tension properties such that it is capable, under ambient or substantially ambient conditions (for example from about 23° C. to about 40° C.), to migrate uniformly throughout a fibrous structure including covering the surface of and, to some extent, the interior of the fibers forming the fibrous structure.

"Surface Softening Agent" as used herein means a chemical agent which is present on the surface of the fibrous structure to a greater degree than the overall fibrous structure and which improves the tactile sensation perceived by the user whom holds a particular paper product and rubs it across her skin. In order to accomplish this, surface softeners inherently are relatively non-migratory. They generally achieve such non-migration properties by being large molecule, solid-phase and/or having reactive moieties which associate with the fibers of the fibrous structure and thus have less tendency to flow to a different area of the fibrous structure.

Fibrous Structures

Nonlimiting examples of fibrous structures of the present invention comprise fibers having at least one bonding moiety selected from the group consisting of bonding moieties capable of forming hydrogen bonds, bonding moieties capable of forming ionic bonds, bonding moieties capable of forming covalent bonds and mixtures thereof.

Nonlimiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

The fibrous structures and/or sanitary tissue products of the present invention may exhibit a basis weight of between about 10 g/m to about 120 g/m$^2$ and/or from about 14 g/m$^2$ to about 80 g/m$^2$ and/or from about 20 g/m$^2$ to about 60 g/m$^2$.

The structures and/or sanitary tissue products of the present invention may exhibit a total (i.e. sum of machine direction and cross machine direction) dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structure and/or sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, non-woven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

In addition to the bulk softening agent, the fibrous structure may comprise other additives, such as other softening additives, solid additives (such as starch, clays), dry strength resins, wetting agents, lint resisting agents, absorbency-enhancing agents, immobilizing agents, especially in combination with emollient lotion surface softening compositions, antiviral agents including organic acids, antibacterial agents, polyol polyesters, and mixtures thereof. Such other additives may be added to the fiber furnish, the embryonic fibrous web and/or the fibrous structure.

Such other additives may be present in the fibrous structure at any level based on the dry weight of the fibrous structure.

The other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendering, slitting, folding, combining with other fibrous structures, and the like.

One particularly useful post processing technique converts the fibrous structure into a sanitary tissue product such as a paper towel, toilet tissue, facial tissue, etc.

Compared to sanitary tissue products similar to those of the present invention but not having the bulk softening agent as described herein, those of the present invention are noted to have unexpectedly low sink time and unexpectedly good combination of sink time and absorbency. Further, the sanitary tissue products of the present invention are noted to have an unexpectedly favorable combination of wet/dry strength ratio. Even further, the sanitary tissue products of the present invention are noted as have unexpectedly low lint scores.

In one example, the fibrous structures and/or sanitary tissue products of the present invention exhibit a sink time of less than the result of the following equation:

[1.3+(0.72×% by weight of bulk softening agent].

In another example, the fibrous structures and/or sanitary tissue products of the present invention exhibit a product of [vertical full sheet (VFS) absorbency×sink time] of greater than about 20 g-sec/g and/or greater than about 25 g-sec/g and/or greater than about 30 g-sec/g and/or greater than about 40 g-sec/g.

In another example, the fibrous structures and/or sanitary tissue products of the present invention comprise greater than about 4% and/or greater than about 6% and/or greater than about 8% and/or greater than about 10% by weight of the bulk softening agent.

In another example, the fibrous structures and/or sanitary tissue products of the present invention exhibit a wet tensile to dry tensile ratio of greater than about 0.12 and/or greater than about 0.14 and/or greater than about 0.16 and/or greater than about 0.18 and/or greater than about 0.20.

In even another example, the fibrous structures and/or sanitary tissue products of the present invention exhibit a wet tensile decay of greater than about 50% and/or greater than about 60% and/or greater than about 65% and/or greater than about 70% and/or greater than about 75%.

Bulk Softening Agent

Nonlimiting examples of suitable bulk softening agents according to the present invention are liquids under ambient conditions. For the purpose of the present invention, ambient condition includes a temperature below about 30° C. In one example, a bulk softening agent in accordance with the present invention exhibits a low surface tension, such as below about 40 dyne/cm determined according to ASTM D2578. Excluded from bulk softening agents are solid crystalline materials, or pastes or waxes with excessive melting or softening points since these materials are incapable of migrating effectively throughout the fibrous structure and/or sanitary tissue product.

Without being bound by theory, inventors believe that the unusually effective migration capability of the bulk softening agents according to the present invention is the exclusion of components capable of forming bonds with bonding moieties present on the fibers of the fibrous structures. For example, by being absent hydroxyl group or amide group functionalities, the bulk softening agents herein are incapable of hydrogen bonding with hydroxyl moieties present on cellulose fibers. By being absent tertiary or quaternary amine moieties the bulk softening agents herein are incapable of ion exchange with uronic acid groups of cellulosic fibers preferred for use in the fibrous structures herein. By being absent aldehyde functionalities, the bulk softening agents herein are not capable of forming hemiacetal linkages through adjacent hydroxyl groups of cellulosic fibers preferred for use in the fibrous structures herein.

In one example, the bulk softening agent comprises an oil. Nonlimiting suitable oils include oils derived from mineral, animal or vegetable sources.

In one example, the bulk softening agent comprises mineral oil. A suitable mineral oil is distributed by Chevron Corporation of San Ramon, Calif. under the tradename "Paralux", such as Paralux 1001 and/or Paralux 6001.

Natural animal and vegetable oils may also be used as the oil. These are triglycerides, i.e. they are glycerol fatty esters with no remaining hydroxyl functionality. The range of fatty chains commonly varies from C8 to C22, with C16 and C18 being the most common. The fatty acid chains can be saturated or unsaturated. In one example, the fatty acid chains will either be unsaturated or shorter (for example C12 or less), both of which tend to liquefy the oil. Saturated and long chain length triglycerides are room temperature solids which are not suitable for the present invention. Examples of suitable oils at each end of the spectrum are soybean oil which is a longer chain length oil having a high level of unsaturation and MCT oil derived from coconut or palm kernel, which is a short chain length but fully saturated oil. Similarly some animal oils are also suitable. However, many animal oils contain too much high molecular weight and/or saturated fat, which makes them not as desirable as other oils. Marine oils are most suitable since they are either absent or can be more easily purified of solid fats, solid monoesters, etc.

Synthetic oils are also suitable. Synthetic mineral oils include those made from synthetic crude oil, i.e. upgraded bitumen. Synthetic oils created by the polymerization of methane by the Fischer-Tropsch process are also suitable.

Synthetic oils made by esterification of alcohols with fatty acids are also suitable or similar processes are included. For example, a methyl ester of fatty acids derived from soybean oil is suitable. The process used to create this oil is to saponify the triglyercide, i.e. soybean oil, with caustic soda in the presence of methanol. This yields glycerine and the methyl esters of the fatty acids, which can be readily separated. The methyl esters thus produce include a blend of methyl stearate, methyl linoleate, methyl linoleneate, and methyl palmitate and minor fractions of others. Similarly, fatty esters of carbohydrates are also acceptable provided they meet the requirements of fluidity and the essentially complete replacement of the alcohol groups with ester functionalities.

Surface Softening Agent

Surface softening agents include any chemical ingredient which imparts a lubricious feel to the fibrous structure and/or sanitary tissue product of the present invention and are present on a surface of the fibrous structure at a level greater than the remainder of the fibrous structure. Nonlimiting examples of suitable surface softening agents includes, for exemplary purposes only, basic waxes such as paraffin and beeswax silicone gels as well as petrolatum and more complex lubricants and emollients such as quaternary ammonium compounds with long (C8-C22) hydrocarbyl chains, functional silicones, and long (C8-C22) hydrocarbyl chain-bearing compounds possessing functional groups such as amines, acids, alcohols and esters.

Generally, surface softening agents are applied by their addition to the fibrous structure and/or sanitary tissue product after the fibrous structure and/or sanitary tissue product is partially or completely dried (for example less than 10% and/or less than 7% and/or less than 5% and/or less than 3% by weight of the fibrous structure (sanitary tissue product) of moisture). Applicable processes can be incorporated into the paper making operation as, for example, by spraying onto the embryonic web and/or dried fibrous structure before it is wound into a roll of paper, extruding, especially via slot extrusion, onto the embryonic web and/or dried fibrous structure, and/or by gravure printing onto the embryonic web and/or dried fibrous structure.

In one example, the surface softening agents are present on a surface of the fibrous structure such that the surface softening agent is contacted by a user's skin during use. In another example, the surface softening agent may comprise a transferable ingredient and/or composition that is capable of transferring to a user's skin during use.

Considerable art has been devised to apply chemical softeners to already-dried paper webs either at the so-called dry end of the papermaking machine or in a separate converting operation subsequent to the papermaking step. Exemplary art from this field includes U.S. Pat. Nos. 5,215,626, 5,246,545 and 5,525,345.

Nonlimiting examples of suitable surface softening agents and processes for applying same to fibrous structures are described in U.S. Pat. Nos. 6,855,229, 6,797,117, 6,755,939, 6,607,637, 6,547,928 and U.S. Patent Publication No. 2004/0255396 A1.

In one example, a surface softening agent comprises a quaternary ammonium softener, an emollient lotion and/or a polysiloxane or silicone.

i. Quaternary Ammonium Softeners

Nonlimiting examples of quaternary ammonium softeners suitable as chemical softening agents of the present invention have the formula:

$$(R^1)_{4-m}—N+—[R^2]_mX^-$$

wherein m is 1 to 3; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^2$ is independently a $C_{14}$-$C_{22}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention.

In one example, each $R^1$ is methyl and $X^-$ is chloride or methyl sulfate, each $R^2$ is independently $C_{16}$-$C_{18}$ alkyl or alkenyl (in one example, each $R^2$ is independently straight-chain $C_{18}$ alkyl or alkenyl).

In another example, the quaternary ammonium softeners comprise mono or diester variations of quaternary ammonium softeners having the formula:

$$(R^1)_{4-m}—N+—[(CH_2)_n—Y—R^3]_mX^-$$

wherein Y is —O—(O)C—, or —C(O)—O—, or —NH—(O)—, or —(O)—NH—; m is 1 to 3; n is 0 to 4; each $R^1$ is independently a $C_1$-$C_6$ alkyl group, hydroxyalkyl group, hydrocarbyl or substituted hydrocarbyl group, alkoxylated group, benzyl group, or mixtures thereof; each $R^3$ is independently a $C_{13}$-$C_{21}$ alkyl group, hydroxyalkyl group, hydrocarbyl or substituted hydrocarbyl group, alkoxylated group, benzyl group, or mixtures thereof, and $X^-$ is any softener-compatible anion.

In one example, Y is —O—(O)C—, or —C(O)—O—; m=2; and n=2.

In another example, each $R^1$ is independently a $C_1$-$C_3$, alkyl group (in one example each $R^1$ is methyl).

In another example, each $R^3$ is independently $C_{13}$-$C_{17}$ alkyl and/or alkenyl (in one example each $R^3$ is independently a straight chain $C_{15}$-$C_{17}$ alkyl and/or alkenyl (in one example each $R^3$ is a straight chain $C_{15}$-$C_{17}$ alkyl and/or each $R^3$ is independently a straight-chain $C_{1-7}$ alkyl).

As mentioned above, $X^-$ can be any softener-compatible anion, for example, acetate, chloride, bromide, methyl sulfate, formate, sulfate, nitrate and the like can also be used in the present invention. In one example, $X^-$ is chloride or methyl sulfate.

In one example, the quaternary ammonium softener comprises DEEDMAMS (diethyl ester dimethyl ammonium methyl sulfate), further defined herein wherein the hydrocarbyl chains are derived from tallow fatty acids optionally partially hardened to an iodine value from about 10 to about 60.

ii. Emollient Lotion Composition

Suitable surface softening agents as defined herein may include emollient lotion compositions. As used herein, an "emollient lotion composition" is a chemical softening agent that softens, soothes, supples, coats, lubricates, or moisturizes the skin. An emollient typically accomplishes several of these objectives such as soothing, moisturizing, and lubricating the skin.

Emollients useful in the present invention can be petroleum-based, fatty acid ester type, alkyl ethoxylate type, or mixtures of these emollients. Suitable petroleum-based emollients include those hydrocarbons, or mixtures of hydrocarbons, having chain lengths of from 16 to 32 carbon atoms. Petroleum based hydrocarbons having these chain lengths include petrolatum (also known as "mineral wax," "petroleum jelly" and "mineral jelly"). Petrolatum usually refers to more viscous mixtures of hydrocarbons having from 16 to 32 carbon atoms. Petrolatum is a particularly preferred emollient for use in fibrous structures that are incorporated onto toilet tissue products and a suitable material is available from Witco, Corp., Greenwich, Conn. as White Protopet® IS.

Suitable fatty acid ester type surface softeners include those derived from long chain $C_{12}$-$C_{28}$ fatty acids, such as $C_{16}$-$C_{22}$ saturated fatty acids, and short chain $C_1$-$C_8$ monohydric alcohols, such as $C_1$-$C_3$ monohydric alcohols. Nonlimiting examples of suitable such fatty acid ester type surface softeners include methyl palmitate, methyl stearate, isopropyl laurate, isopropyl myristate, isopropyl palmitate, and ethylhexyl palmitate. Suitable fatty acid ester emollients can also be derived from esters of longer chain fatty alcohols ($C_{12}$-$C_{28}$, such as $C_{12}$-$C_{16}$) and shorter chain fatty acids e.g., lactic acid, such as lauryl lactate and cetyl lactate.

Suitable alkyl ethoxylate type emollients include $C_{12}$-$C_{18}$ fatty alcohol ethoxylates having an average of from 3 to 30 oxyethylene units, such as from about 4 to about 23. Nonlimiting examples of such alkyl ethoxylates include laureth-3 (a lauryl ethoxylate having an average of 3 oxyethylene units), laureth-23 (a lauryl ethoxylate having an average of 23 oxyethylene units), ceteth-10 (acetyl ethoxylate having an average of 10 oxyethylene units) and steareth-10 (a stearyl ethoxylate having an average of 10 oxyethylene units). These alkyl ethoxylate emollients are typically used in combination with the petroleum-based emollients, such as petrolatum, at a weight ratio of alkyl ethoxylate emollient to petroleum-based emollient of from about 1:1 to about 1:3, preferably from about 1:1.5 to about 1:2.5.

Emollient lotion compositions may include "immobilizing agents", so-called because they are believed to act to prevent migration of the emollient so that it can remain primarily on the surface of the fibrous structure to which it is applied so that it may deliver maximum softening benefit as well as be available for transferability to the users skin. Suitable immobilizing agents for the present invention can comprise polyhydroxy fatty acid esters, polyhydroxy fatty acid amides, and mixtures thereof. To be useful as immobilizing agents, the polyhydroxy moiety of the ester or amide should have at least two free hydroxy groups. It is believed that these free hydroxy groups are the ones that co-crosslink through hydrogen bonds with the cellulosic fibers of the tissue paper web to which the lotion composition is applied and homo-crosslink, also through hydrogen bonds, the hydroxy groups of the ester or amide, thus entrapping and immobilizing the other components in the lotion matrix. Nonlimiting examples of suitable esters and amides will have three or more free hydroxy groups on the polyhydroxy moiety and are typically nonionic in character. Because of the skin sensitivity of those using paper products to which the lotion composition is applied, these esters and amides should also be relatively mild and non-irritating to the skin.

Suitable polyhydroxy fatty acid esters for use in the present invention will have the formula:

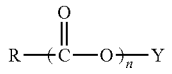

wherein R is a $C_5$-$C_3$, hydrocarbyl group, such as a straight chain $C_7$-$C_{19}$ alkyl or alkenyl and/or a straight chain $C_9$-$C_{17}$ alkyl or alkenyl and/or a straight chain $C_1$-$C_{17}$ alkyl or alkenyl, or mixture thereof; Y is a polyhydroxyhydrocarbyl moiety having a hydrocarbyl chain with at least 2 free hydroxyls directly connected to the chain; and n is at least 1. Suitable Y groups can be derived from polyols such as glycerol, pentaerythritol; sugars such as raffinose, maltodextrose, galactose, sucrose, glucose, xylose, fructose, maltose, lactose, mannose and erythrose; sugar alcohols such as erythritol, xylitol, malitol, mannitol and sorbitol; and anhydrides of sugar alcohols such as sorbitan.

One class of suitable polyhydroxy fatty acid esters for use in the present invention comprises certain sorbitan esters, such as sorbitan esters of $C_{16}$-$C_{22}$ saturated fatty acids. Because of the manner in which they are typically manufactured, these sorbitan esters usually comprise mixtures of mono-, di-, tri-, etc. esters. Nonlimiting examples of suitable sorbitan esters include sorbitan palmitates (e.g., SPAN 40), sorbitan stearates (e.g., SPAN 60), and sorbitan behenates, that comprise one or more of the mono-, di- and tri-ester versions of these sorbitan esters, e.g., sorbitan mono-, di- and tri-palmitate, sorbitan mono-, di- and tri-stearate, sorbitan mono-, di and ri-behenate, as well as mixed tallow fatty acid sorbitan mono-, di- and tri-esters. Mixtures of different sorbitan esters can also be used, such as sorbitan palmitates with sorbitan stearates. In one example, sorbitan esters include sorbitan stearates, typically as a mixture of mono-, di- and tri-esters (plus some tetraester) such as SPAN 60, and sorbitan stearates sold under the trade name GLYCOMUL-S by Lonza, Inc. Although these sorbitan esters typically contain mixtures of mono-, di- and tri-esters, plus some tetraester, the mono- and di-esters are usually the predominant species in these mixtures.

iii. Polysiloxanes and/or Other Silicone Materials

Suitable surface softening agents for the present invention may include silicone materials, such as polysiloxane compounds, cationic silicones, quaternary silicone compounds and/or aminosilicones. In general, suitable polysiloxane materials for use in the present invention include those having monomeric siloxane units of the following structure:

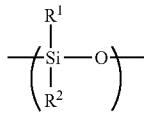

wherein, $R^1$ and $R^2$, for each independent siloxane monomeric unit can each independently be hydrogen or any alkyl, aryl, alkenyl, alkaryl, arakyl, cycloalkyl, halogenated hydrocarbon, or other radical. Any of such radicals can be substituted or unsubstituted. $R^1$ and $R^2$ radicals of any particular monomeric unit may differ from the corresponding functionalities of the next adjoining monomeric unit. Additionally, the polysiloxane can be either a straight chain, a branched chain or have a cyclic structure. The radicals $R^1$ and $R^2$ can additionally independently be other silaceous functionalities such as, but not limited to siloxanes, polysiloxanes, silanes, and polysilanes. The radicals $R^1$ and $R^2$ may contain any of a variety of organic functionalities including, for example, alcohol, carboxylic acid, phenyl, and amine functionalities.

Exemplary alkyl radicals are methyl, ethyl, propyl, butyl, pentyl, hexyl, octyl, decyl, octadecyl, and the like. Exemplary alkenyl radicals are vinyl, allyl, and the like. Exemplary aryl radicals are phenyl, diphenyl, naphthyl, and the like. Exemplary alkaryl radicals are toyl, xylyl, ethylphenyl, and the like. Exemplary aralkyl radicals are benzyl, alpha-phenylethyl, beta-phenylethyl, alpha-phenylbutyl, and the like. Exemplary cycloalkyl radicals are cyclobutyl, cyclopentyl, cyclohexyl, and the like. Exemplary halogenated hydrocarbon radicals are chloromethyl, bromoethyl, tetrafluorethyl, fluorethyl, trifluorethyl, trifluorotloyl, hexafluoroxylyl, and the like.

In one example, suitable polysiloxanes include straight chain organopolysiloxane materials of the following general formula:

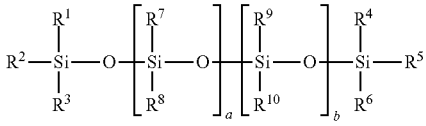

wherein each $R^1$-$R^9$ radical can independently be any $C_1$-$C_{10}$ unsubstituted alkyl or aryl radical, and $R^{10}$ of any substituted $C_1$-$C_{10}$ alkyl or aryl radical. In one example, each $R^1$-$R^9$ radical is independently any $C_1$-$C_4$ unsubstituted alkyl group. Those skilled in the art will recognize that technically there is no difference whether, for example, $R^9$ or $R^{10}$ is the substituted radical. In another example, the mole ratio of b to (a+b) is between 0 and about 20% and/or between 0 and about 10% and/or between about 1% and about 5%.

In one example, $R^1$-$R^9$ are methyl groups and $R^{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxane include, for example, polydimethylsiloxane having an alkyl hydrocarbon $R^{10}$ radical and polydimethylsiloxane having one or more amino, carboxyl, hydroxyl, ether, polyether, aldehyde, ketone, amide, ester, thiol, and/or other functionalities including alkyl and alkenyl analogs of such functionalities. For example, an amino functional alkyl group as $R^{10}$ could be an amino functional or an aminoalkyl-functional polydimethylsiloxane. The exemplary listing of these polydimethylsiloxanes is not meant to thereby exclude others not specifically listed.

Low molecular weight polysiloxanes are notoriously migratory and thus fit the class of bulk softening agents hereinbefore described. However, low molecular weight polysilxones, for example having a viscosity as low as about 350 centistokes and/or 250 centistokes, and/or 125 centistokes, and/or 25 centistokes are useful for this invention as surface softening agents provided that they carry moieties capable of bonding to the cellulose fibers. Much higher molecular weight silicones can be non-migratory surface softeners by virtue of their molecular size.

References disclosing nonlimiting examples of suitable polysiloxanes include U.S. Pat. Nos. 2,826,551, 3,964,500, 4,364,837, 5,059,282, 5,529,665, 5,552,020 and British Patent No. 849,433 and Silicone Compounds, pp. 181-217, distributed by Petrach Systems, Inc., which contains an extensive listing and description of polysiloxanes in general.

Surfactants

In addition to the bulk softening agent, the fibrous structures of the present invention may include a surfactant. Nonlimiting examples of surfactants include anionic, cationic, nonionic, amphoteric surfactant.

A surfactant may be deposited onto a surface of the fibrous structure and become bound via a chemical bond (hydrogen bond, ionic bond and/or covalent bond) to one or more fibers within the fibrous structure.

Optional Ingredients

In addition to the bulk softening agent, and optionally the surface softening agent and/or surfactant, the fibrous structures of the present invention may further comprise additional optional ingredients selected from the group consisting of permanent and/or temporary wet strength resins, dry strength resins, wetting agents, lint resisting agents, absorbency-enhancing agents, antiviral agents including organic acids, antibacterial agents, polyol polyesters, antimigration agents, polyhydroxy plasticizers and mixtures thereof. Such optional ingredients may be added to the fiber furnish, the embryonic fibrous web and/or the fibrous structure.

Such optional ingredients may be present in the fibrous structures at any level based on the dry weight of the fibrous structure.

The optional ingredients may be present in the fibrous structures at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

Processes for Making Bulk Softened Fibrous Structures

Any suitable process for making fibrous structures known in the art may be used to make fibrous structures of the present invention.

In one example, the fibrous structures of the present invention are made by a wet laid fibrous structure making process. In another example, the fibrous structures of the present invention are made by an air laid fibrous structure making process.

In one example, the bulk softening agent is applied to a surface of the fibrous structure (such as a topical application). A topical application means that the material is applied to at least one surface of the fibrous structure. In one example, the bulk softening agent is applied to the fibrous structure after the fibrous structure has been partially dried (less than 10% and/or less than 7% and/or less than 5% and/or less than 3% by weight moisture). In another example, the bulk softening agent is applied to the fibrous structure after it has been completely dried. The "completely dried" state includes dried to the point at which the web is at equilibrium moisture content with the ambient surroundings and also includes a so-called "overdried" state, i.e. one wherein the web actually has less moisture than the web would retain if it were at equilibrium with the surroundings. It is common to overdry webs in wet papermaking in order to insure that all areas of the web are at least substantially at equilibrium dryness.

In one example, the topical application will be by coarse spray. Spraying has been found to be economical, and can be accurately controlled with respect to quantity and distribution of the composition. The dispersed composition can be applied onto the dried, creped tissue web before the web is wound into the parent roll. Those skilled in the art will recognize that spraying transfer efficiency favors large droplet sizes. Compositions with bond-forming moieties are not favorably applied in large droplets. Without being bound by theory, applicants believe that large droplets of bond-forming softening agents cause too much disruption of fiber to fiber bonding locally and further are unable to migrate effectively because of their tendency to be substantively affixed to the fibers. The bulk softening agent of one aspect of the present invention does not suffer from this issue because of the absence of the bond-forming moieties; therefore, application of the bulk softening agent in relatively large particles (if in liquid form—large droplets), most particularly in a particle size distribution wherein at least 10% by weight of the bulk softening agent has a particle size at contact with the fibrous structure of greater than 500 μm.

One acceptable spraying system uses ITW Dynatec UFD nozzles, offered by Illinois Tool Works of Glenview, Ill. One suitable nozzle model has five fluid orifices, each 0.46 mm×0.51 mm in size. The center of the 5 fluid orifices is oriented directly vertical to the path of the tissue paper web, while the outer orifices are angled at 15 degrees off of vertical, and the two intermediate nozzles are angled at 7.5 degrees relative to vertical. Each fluid orifice has an associated air orifice situated on either side of it, for a total of 10 air orifices, each of 0.51 mm×0.51 mm size. The fluid orifice extends 0.5 cm beyond the lower surface of the nozzle. Nozzles are spaced about 5 cm apart and about 5 cm above the tissue paper web while it is being treated. Air pressure sufficient to create a coarsely atomized spray is used.

In one example, the process may comprise the step of making the fibrous structure. In one example, the bulk softening agent may be applied concurrently with the step of making the fibrous structure.

In one example, the process may comprise applying a surface softening agent to the fibrous structure. For example, the surface softening agent may be applied after the bulk softening agent has been applied to the fibrous structure and/or after the bulk softening agent has been uniformly distributed throughout the fibrous structure.

Once the bulk softening agent has been applied, then the fibrous structure may be wound into a roll, for example convolutely wound into a roll.

In one example, the bulk softening agent becomes uniformly distributed throughout the fibrous structure.

NONLIMITING EXAMPLES

Example 1

The following Example illustrates preparation of a fibrous structure and/or sanitary tissue product according to the present invention. A pilot-scale Fourdrinier papermaking machine is used for the production of the tissue.

An aqueous slurry of NSK of about 3% consistency is made up using a conventional repulper and is passed through a stock pipe toward the headbox of the Fourdrinier.

In order to impart temporary wet strength to the finished product, a 1% dispersion of Parez 750® available from Lanxess Corporation is prepared and is added to the NSK stock pipe at a rate sufficient to deliver 0.3% Parez 750® based on the dry weight of the NSK fibers. The absorption of the temporary wet strength resin is enhanced by passing the treated slurry through an in-line mixer.

An aqueous slurry of eucalyptus fibers of about 3% by weight is made up using a conventional repulper.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The paper machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus fibers and 30% is made up of the NSK fibers. This combination results in an average fiber length of about 1.6 mm. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 800 fpm (feet per minute) (about 198 meters per minute).

The embryonic wet web is transferred from the Fourdrinier wire, at a fiber consistency of about 15% at the point of transfer, to a patterned drying fabric made in accordance with U.S. Pat. No. 4,528,239, Trokhan, issued on 9 Jul. 1985. The speed of the patterned drying fabric is the same as the speed of the Fourdrinier wire. The drying fabric is designed to yield a pattern densified tissue with discontinuous low-density deflected areas arranged within a continuous network of high density areas. This drying fabric is formed by casting an impervious resin surface onto a fiber mesh supporting fabric. The supporting fabric is a 45×52 filament, dual layer mesh.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

The semi-dry web is then transferred to the Yankee dryer and adhered to the surface of the Yankee dryer with a sprayed creping adhesive. The creping adhesive is an aqueous solution with the actives in solution consisting of about 50% polyvinyl alcohol, about 35% CREPETROL A3025, and about 15% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 96% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The dry web is passed through a rubber-on-steel calendar nip.

After the calendar, bulk softening agent is spray applied to the web at the rate of 12% by weight. The bulk softening agent is a mineral oil (i.e. Paralux 6001 marketed by Chevron Corporation of San Ramon, Calif.). The spray applicator uses ITW Dynatec UFD nozzles, offered by Illinois Tool Works of Glenview, Ill. The UFD nozzles have five fluid orifices, each 0.46 mm×0.51 mm in size. The center of the 5 fluid orifices is oriented directly vertical to the path of the tissue paper web, while the outer orifices are angled at 15 degrees off of vertical, and the two intermediate nozzles are angled at 7.5 degrees relative to vertical. Each fluid orifice has an associated air orifice situated on either side of it, for a total of 10 air orifices, each of 0.51 mm×0.51 mm size. The fluid orifice extends 0.5 cm beyond the lower surface of the nozzle. Nozzles are spaced about 5 cm apart and about 5 cm above the tissue paper web while it is being treated. Air pressure sufficient to create a coarsely atomized spray is used.

After the bulk softening agent is applied, the paper is wound in a roll using a surface driven reel drum having a surface speed of about 656 feet per minute.

The paper is subsequently converted into a two-ply toilet tissue having a basis weight of about 50 g/m$^2$, of which about 6 g/m$^2$ is bulk softening agent.

Example 2

The following Example illustrates preparation of a fibrous structure and/or sanitary tissue product according to one aspect of the present invention.

The same preparation as Example 1 is used for the preparation of Example 2 except for the following:

During the converting process, a surface softening agent is applied with a slot extrusion die to the outside surface of the product. The surface softening agent is a silicone solution (i.e. MR-1003, marketed by Wacker Chemical Corporation of Adrian, Mich.). The 34% silicone solution is applied to the web at a rate of 0.5% by weight. The paper is subsequently wound into a two-ply toilet tissue having a basis weight of about 50 g/m$^2$, of which about 6 g/m$^2$ is bulk softening agent and about 0.25 g/m$^2$ is silicone surface softening agent.

Test Methods

Horizontal Full Sheet (HFS) Absorbency Test Method:

This method is performed on fibrous structures and/or sanitary tissue products broadly. Fibrous structures and/or sanitary tissue products are referred to in the remainder of this method and the Vertical Full Sheet (VFS) absorbency as "paper". The method is performed by first weighing a sample of the paper to be tested (referred to herein as the "Dry Weight of the paper"), then thoroughly wetting the paper, draining the wetted paper in a horizontal position and then reweighing (referred to herein as "Wet Weight of the paper"). The absorptive capacity of the paper is then computed as the amount of water retained in units of grams of water absorbed by the paper. When evaluating different paper samples, the same size of paper is used for all samples tested.

The apparatus for determining the HFS capacity of paper comprises the following: An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the paper tested (i.e. about 11 in. (27.9 cm) by 11 in. (27.9 cm)). The balance pan can be made out of a variety of materials. Acrylic sheet is a common material used for the balance pan.

A sample support rack and sample support cover is also required. Both the rack and cover are comprised of a lightweight metal frame, strung with 0.015 in. (0.38 cm) diameter monofilament so as to form a grid of 0.5 inch×0.5 inch squares (1.27 cm×1.27 cm). The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

Carefully place the sample to be tested on the balance and weigh to the nearest 0.01 grams. This is the dry weight of the sample. For bath tissue, it is recommended that six usable units be used in the test. For kitchen roll towels, two usable units are recommended. If another product format is to be tested, an area from 100-200 in2 is recommended. A usable unit is described as one finished product unit regardless of the number of plies. The empty sample support rack is placed on the balance with the special balance pan described above. The balance is then zeroed (tared). The sample is carefully placed on the sample support rack. The support rack cover is placed on top of the support rack. The sample (now sandwiched between the rack and cover) is submerged in the water reservoir. After the sample has been submerged for 60 seconds, the sample, support rack and cover are gently raised out of the reservoir.

The sample, support rack and cover are allowed to drain horizontally for 120±5 seconds, taking care not to excessively shake or vibrate the sample. Next, the rack cover is carefully removed and the wet sample and the support rack are weighed on the previously tared balance. The weight is recorded to the nearest 0.01 grams. This is the wet weight of the sample.

The gram per paper sample absorptive capacity of the sample is defined as (Wet Weight of the paper−Dry Weight of the paper). The Horizontal Full Sheet Absorbent Capacity (HFS) is defined as:

$$HFS = \frac{(\text{Wet Weight of the paper} - \text{Dry Weight of the paper})}{(\text{Dry Weight of the paper})}$$

and has a unit of gram/gram.

Vertical Full Sheet (VFS) Absorbency Test Method:

This method is completed by first performing the Horizontal Full Sheet (HFS) absorbency method described previously herein through the point at which "the sample, support rack and cover are allowed to drain horizontally for 120±5 seconds, taking care not to excessively shake or vibrate the sample.", then continue by, next, allowing the sample and support rack to drain vertically for 60±5 seconds. Next, the rack cover is carefully removed and the wet sample and the support rack are weighed on the previously tared balance. The weight is recorded to the nearest 0.01 grams. This is the wet weight of the sample.

The gram per paper sample absorptive capacity of the sample is defined as (Wet Weight of the paper−Dry Weight of the paper). The Vertical Full Sheet Absorbent Capacity (VFS) is defined as:

$$VFS = \frac{(\text{Wet Weight of the paper} - \text{Dry Weight of the paper})}{(\text{Dry Weight of the paper})}$$

and has a unit of gram/gram.

Sink Time Test:

The sink time test is designed to be used with one usable unit of toilet tissue, i.e. a 4"×4.5" product size irrespective of number of plies. The test may additionally be applied to other sanitary tissue products or fibrous structures in general. In this case, the fibrous structure or product should first be prepared by cutting a 4"×4.5" area. Although applicable to fibrous structures in general, the sample will be referred to as "paper" for the purposes of this method.

First, conditioned sample paper is provided. The environmental conditions for testing of paper samples are 23±1° C. and 50±2% relative humidity, as specified in TAPPI Method T 402. Next, the sample of tissue is folded into four juxtaposed quarters, and then crumpled by hand (hands are either covered with clean plastic gloves or copiously washed with a grease removing detergent such as Dawn®, a product of the Procter & Gamble Company) into a ball about 20 mm to about 25 mm in diameter. Next, fill a glass beaker with 3 liters of distilled water at 23±1° C. Do not stir or agitate the water during testing. The sample ball is gently placed on the surface of the water from a distance no greater than 4 cm above the water surface. At the exact moment the ball touches the water surface, a timer is simultaneously started. When the first ball wets out completely, a second ball is immediately placed in the water in the same gentle technique described above. When the second ball wets out, add a third ball, then a fourth, and finally a fifth ball; in each case waiting until the previous ball wets out completely before adding the next one. Complete wetting is easily noted by the paper color transitioning from its dry white color to a darkish grayish. The timer is stopped and the time recorded to the nearest 0.1 sec after the fifth ball has completely wet out. At least 5 sets of 5 balls (for a total of 25 balls) should be run for each sample. The Sink Time is defined as:

$$\text{Sink Time} = \frac{(\text{Total time recorded})}{(\text{Number of balls tested})}$$

The units of measurement are seconds. The water must be changed after the 5 sets of 5 balls have been tested. Copious cleaning of the beaker may be necessary if a film or residue is noted on the inside wall of the beaker.

All documents cited in the Detailed Description of the Invention are, in relevant part, incorporated herein by reference; the citation of any document is not to be construed as an admission that it is prior art with respect to the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A polar agent-free fibrous structure comprising one or more fibers and a non-silicone oil system comprising a bulk softening agent substantially uniformly distributed throughout the fibrous structure wherein the bulk softening agent is present in the fibrous structure as a liquid.

2. The fibrous structure according to claim 1 wherein at least one of the one or more fibers comprises cellulose.

3. The fibrous structure according to claim 1 wherein the bulk softening agent comprises an oil selected from the group consisting of mineral oil, animal oil, vegetable oil and mixtures thereof.

4. The fibrous structure according to claim 1 wherein the fibrous structure further comprises a surface softening agent.

5. The fibrous structure according to claim 4 wherein at least a portion of the surface softening agent is present on a surface of the fibrous structure.

6. The fibrous structure according to claim 4 wherein the surface softening agent comprises a cationic material.

7. The fibrous structure according to claim 6 wherein the cationic material comprises a quaternary nitrogen.

8. The fibrous structure according to claim 4 wherein the surface softening agent comprises a silicon-moiety containing agent.

9. The fibrous structure according to claim 8 wherein the silicon-moiety containing agent is an aminosilicone.

10. A single- or multi-ply sanitary tissue product comprising a fibrous structure according to claim 1.

11. The sanitary tissue product of claim 10 wherein the product of [vertical full sheet absorbency×sink time] is greater than about 20 g-sec/g.

12. The sanitary tissue product according to claim 10 wherein the non-silicone oil system comprises a bulk softening agent.

13. The sanitary tissue product of claim 12 wherein the product exhibits a sink time less than about [1.3+(0.72×% by weight of bulk softening agent)].

14. The sanitary tissue product of claim 12 comprising more than about 4% bulk softening agent and wherein the tissue product has a wet tensile to dry tensile ratio of greater than about 0.12.

15. The sanitary tissue product according to claim 10 wherein the product exhibits a wet tensile decay of greater than about 50%.

16. The sanitary tissue product according to claim 10 wherein the sanitary tissue product exhibits a lint score of less than about 6.

17. A polar agent-free fibrous structure comprising a bulk softening agent and a surface softening agent, wherein the surface softening agent is present on a surface of the fibrous structure such that the surface softening agent is capable of being contacted by a user's skin during use and wherein the bulk softening agent is substantially uniformly distributed throughout the fibrous structure wherein the bulk softening agent is present in the fibrous structure in liquid form.

* * * * *